US007356852B2

(12) United States Patent
Thai

(10) Patent No.: US 7,356,852 B2
(45) Date of Patent: Apr. 15, 2008

(54) LATEX GLOVE WITH TEXTURED OUTER SURFACE

(75) Inventor: Stanley Thai, Naperville, IL (US)

(73) Assignee: Supermax, Inc., Naperville, IL (US)

( * ) Notice: Subject to any disclaimer, the term of this patent is extended or adjusted under 35 U.S.C. 154(b) by 0 days.

(21) Appl. No.: 10/926,128

(22) Filed: Aug. 25, 2004

(65) Prior Publication Data

US 2006/0041991 A1 Mar. 2, 2006

(51) Int. Cl.
*A41D 19/00* (2006.01)

(52) U.S. Cl. ..... 2/161.7; 2/168

(58) Field of Classification Search ..... 2/161.7, 2/161.8, 168, 169; 15/227
See application file for complete search history.

(56) References Cited

U.S. PATENT DOCUMENTS

| | | | | |
|---|---|---|---|---|
| 1,279,855 | A * | 9/1918 | Garvey | 2/168 |
| 2,187,430 | A * | 1/1940 | Olmsted et al. | 2/168 |
| 4,084,265 | A * | 4/1978 | Anfelt | 2/163 |
| 5,794,266 | A * | 8/1998 | Han | 2/159 |
| 5,983,395 | A * | 11/1999 | Lei | 2/159 |
| 6,578,205 | B1 * | 6/2003 | King | 2/161.7 |

* cited by examiner

*Primary Examiner*—Katherine Moran
(74) *Attorney, Agent, or Firm*—Stephen E. Feldman

(57) ABSTRACT

An ambidextrous, latex glove is provided with a textured surface on the areas of the glove corresponding with the touch parts of fingers and a palm. That is, the areas on a hand that are used for gripping and holding are covered with a textured latex surface, providing increased friction for improved gripping.

8 Claims, 4 Drawing Sheets

LATEX GLOVE WITH TEXTURED OUTER SURFACE

FIELD OF THE INVENTION

The present invention deals with gloves and more specifically, specially textured (raised diamond pattern texture) type of gloves that are designed to provide hand protection, comfort, tactile sensitivity and most importantly non-slip advantages to enhanced grip for users.

BACKGROUND OF THE INVENTION

For many years, gloves have been widely used as a primary barrier protection against the spread of diseases in various situations, including direct medical care, surgery, dental care and food handling purposes. To glove users, the essential properties apart from protection are the comfort and ease of movement in performing their routine duties while gloves are being worn.

Conventional non-textured gloves are manufactured with smooth surfaces that do not possess good tactile sense and non-slip qualities. These gloves become slippery when in use, more so when in contact with water or fluid. This causes strain and discomfort to the fingers and hands of the users since extra effort is required to maintain a sturdy grip of their equipment while using gloves. Users also experience less flexibility of hand and finger movement and reduced tactile sense that consequently affects the precision and accuracy of the duties.

The invention of raised diamond pattern-textured gloves is aimed at providing an improved alternative to the standard conventional gloves so as to minimize/eliminate the above-mentioned problems.

In the medical field, gloves are worn to maintain a sterile environment and to protect both the patient and the medical personnel from infection or transmission of viruses and bacteria. The outer surface of latex and rubber gloves is smooth and becomes slippery when wet.

It is desirable, therefore, to provide a latex glove with a palm surface having a geometric pattern to provide improved gripping ability.

SUMMARY OF THE INVENTION

An ambidextrous, latex glove of unitary construction and uniform composition is provided with a textured surface on the areas of the glove corresponding with the touch portions of fingers and a palm. That is, the areas on a hand that are used for gripping and holding are covered with a textured latex surface, providing increased friction for improved gripping.

In further detail, the glove comprises a palm part having a palm-first side and a palm-second side, and a finger part having a finger-first side and a finger-second side. At least a portion of the palm-first side, has a geometric pattern thereon, such as a raised diamond pattern pattern.

BRIEF DESCRIPTION OF THE DRAWINGS

FIGS. 4*a-f* are close-up views of a textured gripping surface in accordance with an embodiment of the present invention.

DETAILED DESCRIPTION

Figure 1:
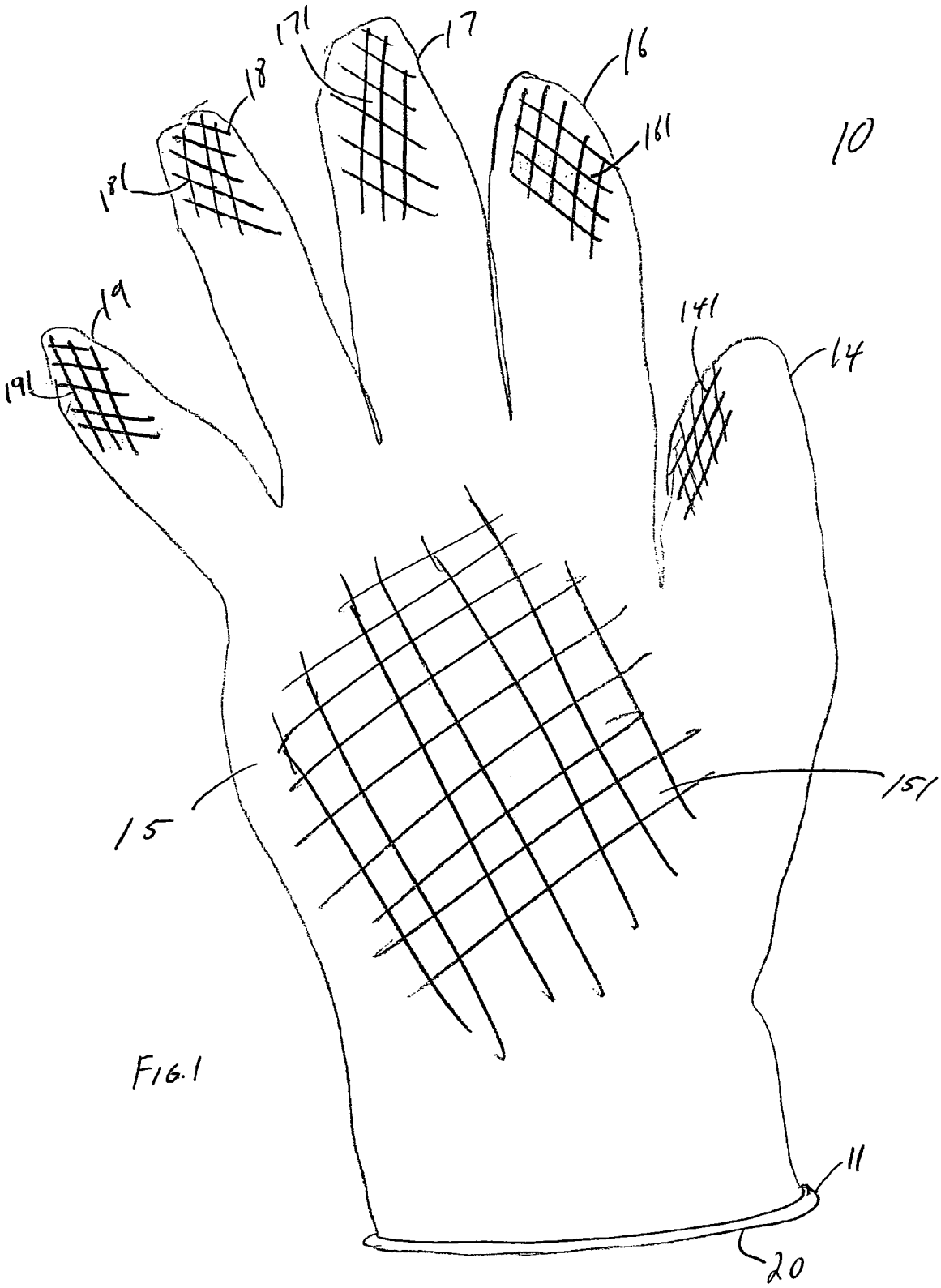
FIG. 1 shows a first side of a latex glove in accordance with an embodiment of the present invention.

An ambidextrous, latex glove is provided with a geometric pattern on the areas of the glove corresponding with the touch portions of fingers and a palm. That is, the areas on a hand that are used for gripping and holding are covered with a raised, geometric pattern such as a raised diamond pattern, providing increased friction for improved gripping.

Raised diamond pattern-textured gloves according to the present invention are gloves which have a unique series of homogenous diamond-like pattern ('Raised diamond pattern Texture') embossed as part of the glove. This texture can be position on gloves at the palm area, fingertips section, back of the hand or the entire surface area of the glove. These gloves can be used for all purposes and manufactured from all types of materials.

Raised diamond pattern-textured formers are moulds used in the manufacturing of raised diamond pattern-textured gloves and which are specially carved with the raised diamond pattern-texture pattern.

Raised diamond pattern-textured gloves according to an embodiment of the present invention preferably have a unique series of homogenous diamond-like pattern (referred to herein as a raised diamond pattern-texture) at the palm area, fingertips surface and the back of the hand. This pattern has an embossed effect on the gloves as the textured sections of the gloves are slightly raised above remaining non-textured smooth surface areas.

The raised diamond pattern texture offers several benefits. The most significant is an enhanced non-slip grip arising from the embossed coarser glove surface created from the effects of the raised diamond pattern texture. Feedback from users has indicated that they experience a reduction in tactile sensitivity when using other types of textured gloves. It is believed that this is because these gloves do not have a series of homogenous pattern. The pattern of raised diamond pattern-textured gloves was engineered with maximum tactile sensitivity in consideration and produced to ensure that the textured surface does not compromise this aspect. Therefore, users still maintain the same tactile sensitivity offered by conventional gloves.

Furthermore, the raised diamond pattern texture also helps to inhibit water retention on the gloves when the users come in contact with liquid. This is another factor that helps in providing better grip as compared to conventional non-textured gloves whereby there is an increase risk of instrument mishandling.

This is especially useful for those users who wear gloves when handling smaller instruments and/or while engaging in intricate procedures. For example, dentists will feel a noticeable difference in the reduction in slipperiness of holding his instruments during dental procedures.

In addition, Raised diamond pattern-textured gloves also provide good donning qualities. These gloves can be easily put onto the hand the usual way conventional gloves are worn.

The gloves are manufactured from a specially designed raised diamond pattern-textured porcelain glove mould (formers). Formers are dipped in the compounding ingredients to produce the inventive gloves.

Figure 3:
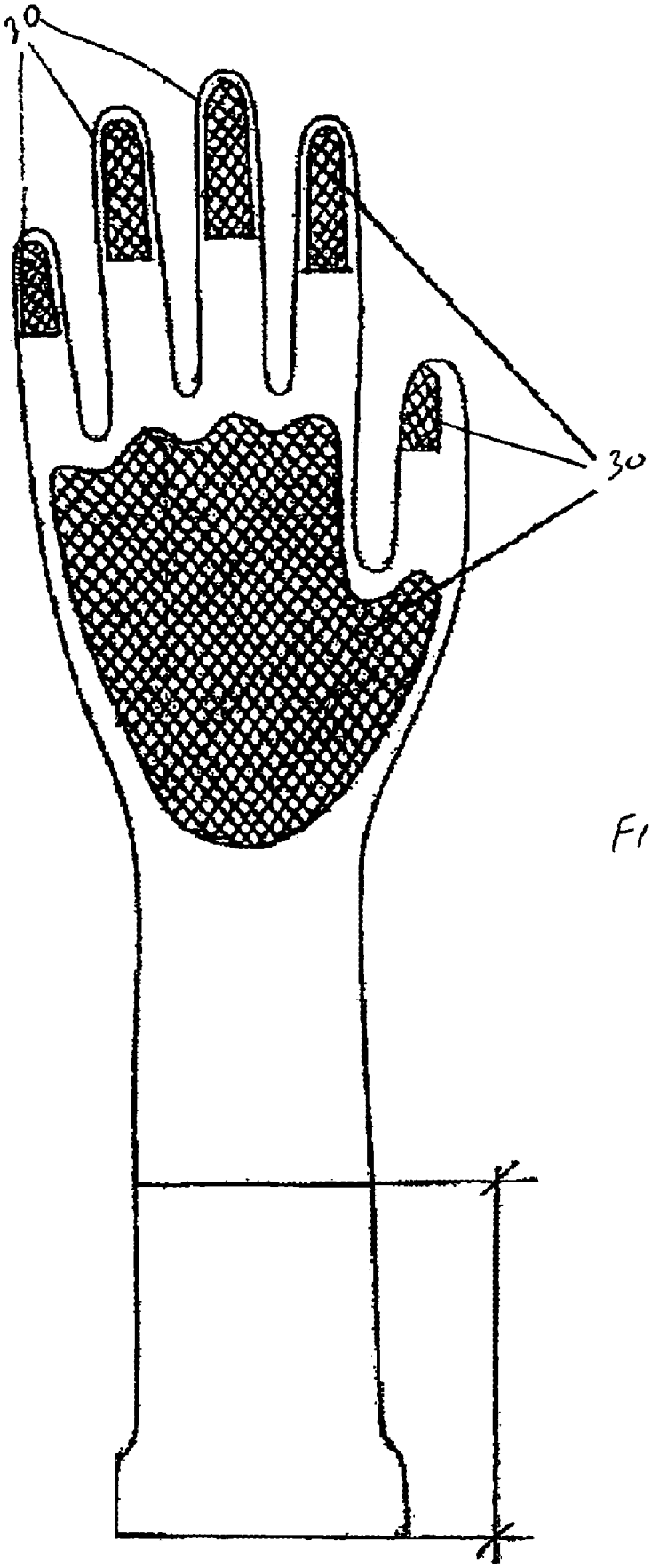
FIG. 3 shows a former in accordance with an embodiment of the present invention.
Figure 4A:
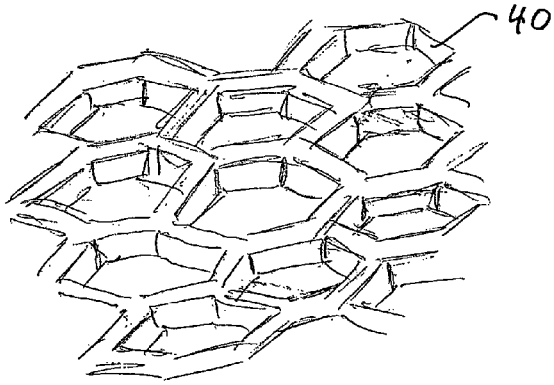
Figure 4B:
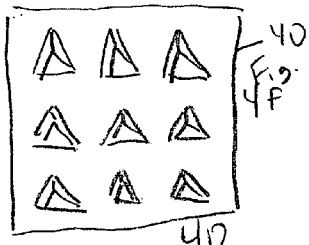
Figure 4B:
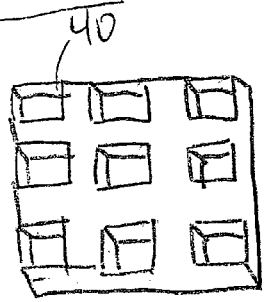
Figure 4D:
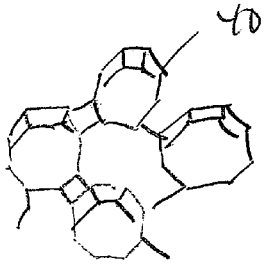
Figure 4C:
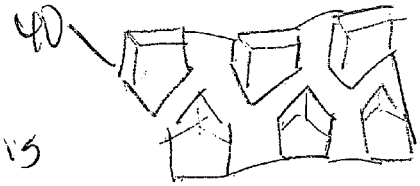
Figure 4E:
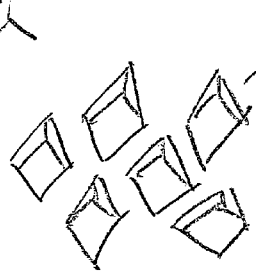

FIG. 3 provides an illustration of a raised diamond pattern-textured former which come either as glazed or unglazed. The formers are shaped like a hand with a palm part and five finger extensions attached to the palm part.

These formers preferably come in different sizes, such as extra-small, small, medium, large and extra-large, which correlate to the size of the inventive gloves produced from the formers. The raised diamond pattern-textured sections of the formers, are indicated by reference numeral 30.

Figure 2:
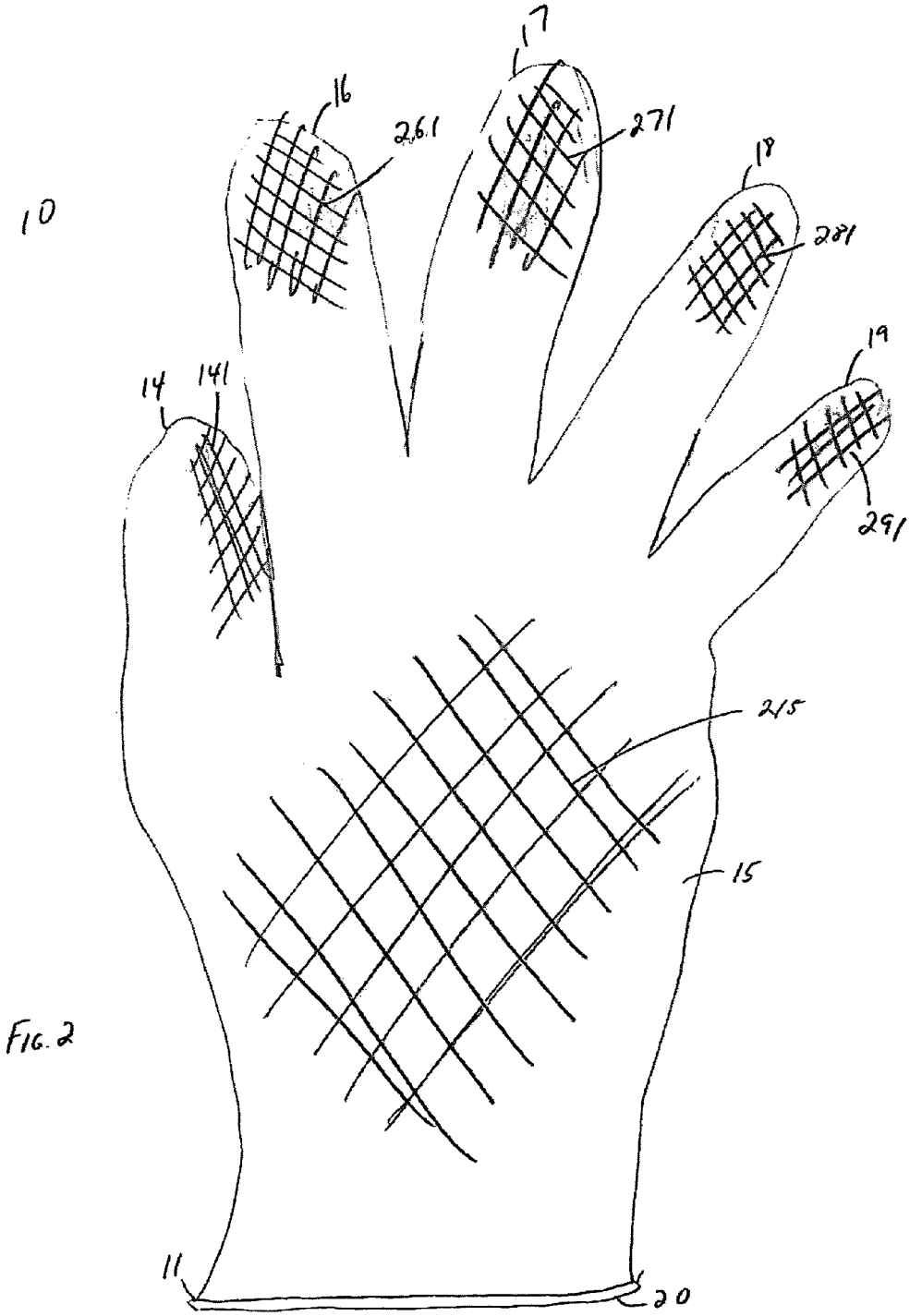
FIG. 2 shows a second side of the latex glove in FIG. 1.

FIG. 1 shows a first-side view of a glove in accordance with an embodiment of the present invention. FIG. 2 shows a second-side view of the glove in FIG. 1. The glove 10 is of unitary construction and uniform composition, namely a single piece of hollow latex formed in the shape of a hand.

The first-side and second-side views are mirror images of each other because the glove 10 is substantially flat, so that it can be worn on either the right or left hand. By being flat, the thumb portion 14 is positioned laterally next to the finger portions 16, 17, 18 and 19. In other words, the thumb portion 14 is in the same plane as the finger portions 16, 17, 18 and 19.

The glove, generally indicated by reference numeral 10, has an opening 20 for receiving the hand of a user. The glove 10 is formed in a traditional shape and includes a thumb part or portion 14, a palm part 15, a pointer finger part 16, middle finger part 17, a ring finger part 18 and a pinky part 19.

The glove 10 is ambidextrous, that is, may be used for a left or right hand. The glove 10 only needs to be positioned with the thumb part 14 on the side corresponding with the hand on which it would be worn.

For example, assume the glove 10 is to be put on a hand (not shown) with the palm of the hand facing up. To wear the glove 10 on the right hand, it would be positioned with the thumb part 14 on the right side to correspond with the thumb position of a right hand, palm-up. For a left hand with its palm facing up, the glove 10 would be flipped over to position the thumb part 14 on the left side.

Referring to FIGS. 1 and 2, the glove 10 according to the present invention is largely comprised of a palm part or portion 15 and finger parts or portions, one for each finger of a human hand. There is a thumb portion 14 to snugly fit around a thumb, a pointer finger portion 16, a middle finger portion 17, a ring finger portion 18, and a pinky portion 19. Each finger portion 16, 17, 18, 19 and 14 is substantially cylindrical, tapering and rounded at its end.

A band 11 is included around the opening 20 and encased by the latex rubber material of the glove's construction. The band 11 ensures a snug, proper fit, and prevents the glove 10 from rolling upward on the hand of a user.

Referring to FIG. 1, showing the first side of the glove 10, it is shaped in the normal manner, like a human hand. It is a hollow piece of stretchable latex rubber with a band 11 around its opening 20. There is a hollow, cylindrical thumb portion 14 into which a thumb (not shown) is inserted. A grip surface 141 is provided on the inside of the thumb portion 14. The grip surface 141 is positioned on the thumb portion 14 to correspond to the area of the thumb that would contact an object in the handling of that object.

A cylindrical pointer finger portion 16 is tapered at the top end, like a human finger, to provide a snug fit so that the portion 16 takes the shape of the pointer finger (not shown). A first-pointer-finger-gripping surface 161 is disposed on the first side of the pointer-finger portion 16 corresponding to the fingertip. The gripping surface 161 covers about 20-75%, preferably 30-60% and most preferably about 50% of the first side of the pointer-finger portion 16.

A cylindrical middle-finger portion 17 is tapered at the top end, like a human finger, to provide a snug fit so that the portion 17 takes the shape of the middle finger (not shown). A first-middle-finger-gripping surface 171 is disposed on the first side of the middle-finger portion 16 corresponding to the fingertip. The gripping surface 171 covers about 20-75%, preferably 30-60% and most preferably about 50% of the first side of the middle-finger portion 17.

A cylindrical ring-finger portion 18 is tapered at the top end, like a human finger, to provide a snug fit so that the portion 18 takes the shape of the ring finger (not shown). A first-ring-finger-gripping surface 181 is disposed on the first side of the ring finger portion 18 corresponding to the fingertip. The gripping surface 181 covers about 20-75%, preferably 30-60% and most preferably about 50% of the first side of the ring-finger portion 18.

A cylindrical pinky-finger portion 19 is tapered at the top end, like a human finger, to provide a snug fit so that the portion 19 takes the shape of the pinky finger (not shown). A first-pinky-finger-gripping surface 191 is disposed on the first side of the pinky-finger portion 19 corresponding to the fingertip. The gripping surface 191 covers about 20-75%, preferably 30-60% and most preferably about 50% of the first side of the pinky-finger portion 19.

A first-side-palm-gripping surface 151 is disposed on the first side of the palm portion 15 as well, covering 50-95%, preferably 75-95% and most preferably 85% of the palm portion 15.

FIG. 2 shows the second side of the glove 10. From this side, the glove 10 is a mirror image of the first side shown in FIG. 1. The thumb portion 14 is on the other side with the gripping surface 141 on the inside of the thumb portion 14.

The cylindrical pointer finger portion 16 has a second-pointer-finger-gripping surface 261 disposed on the second side of the pointer-finger portion 16 corresponding to the fingertip. The gripping surface 261 covers about 20-75%, preferably 30-60% and most preferably about 50% of the second side of the pointer-finger portion 16.

The cylindrical middle finger portion 17 has a second-pointer-finger-gripping surface 271 disposed on the second side of the middle-finger portion 17 corresponding to the fingertip. The gripping surface 271 covers about 20-75%, preferably 30-60% and most preferably about 50% of the second side of the middle-finger portion 16.

The cylindrical ring finger portion 18 has a second-ring-finger-gripping surface 281 disposed on the second side of the ring-finger portion 18 corresponding to the fingertip. The gripping surface 281 covers about 20-75%, preferably 30-60% and most preferably about 50% of the second side of the ring-finger portion 18.

The cylindrical pinky finger portion 19 has a second-pinky-finger-gripping surface 291 disposed on the second side of the pinky-finger portion 19 corresponding to the fingertip. The gripping surface 291 covers about 20-75%, preferably 30-60% and most preferably about 50% of the second side of the pinky-finger portion 19.

A palm gripping surface 215 is disposed on the second side of the palm portion 15 as well. In accordance with a preferred embodiment, the gripping surfaces all include the raised diamond pattern-textured pattern.

When a user (wearer) dons the anti-slip latex glove 10 according to the present invention, it stretches as necessary, so that a snug fit, one which supports and bolsters the grip, is maintained. The textured gripping surfaces preferably include raised, repeated geometric shapes such as squares, pentagons, hexagons, octagons, triangles, and any other straight-edged shape.

FIGS. 4*a-f* show expanded views of different types of textured gripping surface according to a preferred embodiment of the present invention. The textured gripping surface

40 is repeated, each textured shape 40 being adjacent to another. This design is engraved on the former to emboss it on the glove.

In the preceding specification, the invention has been described with reference to specific exemplary embodiments thereof It will however, be evident that various modifications and changes may be made thereto without departing from the broader spirit and scope of the invention as set forth in the claims that follow. The specification and drawings are accordingly to be regarded in an illustrative manner rather than a restrictive sense.

What is claimed is:

1. A surgical glove constructed from a latex material and having an opening comprising:

an interior surface;

an exterior surface;

a palm section;

a plurality of finger sections;

a band, the band being located around the opening and being encased by the latex material, the band ensuring a proper fit and prevents the glove from rolling upwards; and an embossed surface, the embossed surface extending from the interior surface to the exterior surface and having an interior side and exterior side, respectively, the embossed surface being a raised, geometric-textured surface disposed on at least 50% of the palm section and at least 20% of the finger sections, the raised, geometric-textured surface being formed from a plurality of geometric shapes that lie adjacent and touch each other, the interior side providing tactile sensitivity to a user and an exterior side providing a non-slip surface that inhibits water retention to a working surfaces whereby the glove is of unitary construction and uniform composition.

2. The glove of claim 1 wherein the plurality of finger sections includes a thumb section and four finger sections.

3. The glove of claim 1 wherein the raised, geometric-textured surface is a unique series of homogenous diamonds.

4. The glove of claim 1 wherein the raised, geometric-textured surface is a unique series of homogenous squares.

5. The glove of claim 1 wherein the raised, geometric-textured surface is a unique series of homogenous octagons.

6. The glove of claim 1 wherein the raised, geometric-textured surface is a unique series of homogenous pentagons.

7. The glove of claim 1 wherein the raised, geometric-textured surface is a unique series of homogenous hexagons.

8. The glove of claim 1 wherein the raised, geometric-textured surface is a unique series of homogenous triangles.

* * * * *